US011987951B2

(12) United States Patent
Gao et al.

(10) Patent No.: US 11,987,951 B2
(45) Date of Patent: May 21, 2024

(54) LAND LEVELLER

(71) Applicants: JIANGSU XCMG CONSTRUCTION MACHINERY RESEARCH INSTITUTE LTD., Jiangsu (CN); XUZHOU XUGONG ROAD CONSTRUCTION MACHINERY CO., LTD, Jiangsu (CN)

(72) Inventors: Le Gao, Jiangsu (CN); Penglong Hou, Jiangsu (CN); Junjie Duan, Jiangsu (CN)

(73) Assignees: JIANGSU XCMG CONSTRUCTION MACHINERY RESEARCH INSTITUTE LTD., Jiangsu (CN); XUZHOU XUGONG ROAD CONSTRUCTION MACHINERY CO., LTD., Jiangsu (CN)

( * ) Notice: Subject to any disclaimer, the term of this patent is extended or adjusted under 35 U.S.C. 154(b) by 1077 days.

(21) Appl. No.: 16/480,525

(22) PCT Filed: Jan. 28, 2019

(86) PCT No.: PCT/CN2019/073484
§ 371 (c)(1),
(2) Date: Apr. 10, 2020

(87) PCT Pub. No.: WO2020/113806
PCT Pub. Date: Jun. 11, 2020

(65) Prior Publication Data

US 2020/0378086 A1 Dec. 3, 2020

(51) Int. Cl.
*E02F 9/00* (2006.01)
*E02F 3/76* (2006.01)

(52) U.S. Cl.
CPC ..... *E02F 9/006* (2013.01); *E02F 3/7622* (2013.01)

(58) Field of Classification Search
CPC ..... E02F 3/7631; E02F 3/7627; E02F 3/7622; E02F 3/7636; E02F 3/7663; E02F 3/765; E02F 3/7677; E02F 9/006; B62D 27/02
See application file for complete search history.

(56) References Cited

U.S. PATENT DOCUMENTS 3,739,861 A * 6/1973 Johnson ..... E02F 3/765 172/793
5,495,898 A * 3/1996 McGugan ..... E02F 3/7654 172/780
8,291,999 B2 10/2012 Howson et al.

FOREIGN PATENT DOCUMENTS

CN 204940383 U 6/2016
CN 205502103 U 8/2016
(Continued)

OTHER PUBLICATIONS

International Search Report received in PCT/CN2019/073484, dated Aug. 16, 2019.

*Primary Examiner* — Jessica H Lutz
(74) *Attorney, Agent, or Firm* — Kilpatrick Townsend & Stockton LLP

(57) ABSTRACT

A land leveller includes a vehicle frame and a swing frame. The swing frame include a supporting beam assembly and connecting parts, the supporting beam assembly include multiple beam members, and the multiple beam members are connected sequentially at end parts, such that the multiple beam members form a closed shape. The connecting part is arranged at the connecting end part between two adjacent beam members. At least one connecting part is rotatably connected with the vehicle frame, and at least another connecting part is rotatably connected with a driving part.

11 Claims, 7 Drawing Sheets

(56) References Cited

FOREIGN PATENT DOCUMENTS

| | | | |
|---|---|---|---|
| CN | 207419565 | U | 5/2018 |
| CN | 106498996 | B | 9/2018 |

* cited by examiner

LAND LEVELLER

CROSS-REFERENCE TO RELATED APPLICATIONS

The present disclosure is based on and claims the priority of the application filed on Dec. 5, 2018 with the application number of CN201811476371.1, and the contents disclosed in the CN application are incorporated herein in its entirety.

FIELD OF THE INVENTION

The present disclosure relates to the field of engineering machinery, in particular to a land leveler.

DESCRIPTION OF RELATED ART

As a major machine used for shaping and leveling operations in earthwork, a land leveler is essential equipment in such constructions as national defense engineering, mine construction, road construction, water conservancy construction and farmland improvement. The inventor discovered that, since a scraper knife of the land leveler complete 6-DOF motions in a space, therefore, the land leveler possesses a wide range of auxiliary operating capabilities, wherein as its main load-bearing structure, a swing frame structure is a key structure to complete these operations, and the stability of the swing frame is related to the stability of a whole vehicle. Especially during ditching and slope scraping operations, the swing frame swings to its limit position, such that the scraper knife stands sideward by 90 degrees.

At present, the swing frame structure used on a land leveler is a casting piece, and is T-shaped or Y-shaped.

The inventor has discovered that, at least the following problems exist in related technologies: for related land levelers, due to an unreasonable design of the swing frame structure, stiffness and strength of the swing frame are poor, such that during ditching and slope scraping operations, a bending moment of the swing frame of the land leveler is large, and the swing frame is easily torn, thereby influencing stability of the whole vehicle. After the size of the structure is enlarged, the stiffness and strength are improved, however, the big weight is not beneficial for lightweight design of the swing frame structure.

SUMMARY OF THE INVENTION

The present disclosure provides a land leveler to optimize the structure of a swing frame.

The present disclosure provides a swing frame, comprising:

a vehicle frame, and a swing frame which comprises a supporting beam assembly and connecting parts, wherein the supporting beam assembly comprises multiple beam members, and the multiple beam members are connected sequentially at end parts, such that the multiple beam members form a closed shape; the connecting part is arranged at the connecting end part between two adjacent beam members;

and at least one connecting part is rotatably connected with the vehicle frame, and at least another connecting part is rotatably connected with a driving part.

In some embodiments, the supporting beam assembly comprises:

a first beam member;

a second beam member, with a first end being connected with a first end of the first beam member; and a third beam member, with a first end being connected with a second end of the second beam member, and a second end being connected with a second end of the first beam member.

In some embodiments, at least one of the first beam member, the second beam member and the third beam member is straight or bent.

In some embodiments, the cross section of at least one of the first beam member, the second beam member and the third beam member is rectangular, circular, I-shaped or U-shaped.

In some embodiments, the first beam member, the second beam member and the third beam member are of the same strength.

In some embodiments, the first beam member and the second beam member have the same length.

In some embodiments, the first beam member and the third beam member have the same length.

In some embodiments, the first beam member, the second beam member and the third beam member enclose a triangle with a gap in the center.

In some embodiments, the supporting beam assembly is constructed to be an isosceles triangle.

In some embodiments, the supporting beam assembly is constructed to be an equilateral triangle.

In some embodiments, the supporting beam assembly is welded.

In some embodiments, the supporting beam assembly is cast.

In some embodiments, the connecting parts include a first connecting part and a second connecting part, two first connecting parts are available, and each of the two first connecting parts is respectively arranged at two top ends of the supporting beam assembly; and the second connecting part is arranged at another top end of the supporting beam assembly.

In some embodiments, the first connecting part is constructed to be cylindrical, and/or the second connecting part comprises two hinged ears which are arranged at intervals.

In some embodiments, the driving part comprises an oil cylinder; one of the first connecting parts is rotatably connected with a connecting plate of a front rack of the vehicle frame, another first connecting part is rotatably connected with the oil cylinder; the second connecting part is rotatably connected with a beam of the front rack of the vehicle frame; and the connecting plate of the front rack, the beam of the front rack, the swing frame and the oil cylinder form a four-bar mechanism.

In the above technical solution, a supporting beam assembly with the end parts being connected sequentially is adopted, wherein each beam of the supporting beam assembly bears weights. With three beams as an example, the supporting beam assembly is approximately a triangle. The supporting beam assembly bears the bending resistance and torsion resistance effects of the swing frame. In the using process, each side of the supporting beam assembly plays a role of bearing and supporting, thereby improving stress of the swing frame, improving bearing capability of the swing frame, and avoiding the disadvantage that a single beam bears a bending force and a torsion caused by a T-shaped or Y-shaped structure in the related technology. Moreover, for the supporting beam of the above structure, under the same bearing capability, the supporting beam assembly with the above structure has a smaller structure, good performance, small occupied size, and light weight, thereby being beneficial for performance improvement of the whole vehicle, and beneficial for implementation of lightweight design of the whole vehicle.

DESCRIPTION OF THE INVENTION

A detailed description will be given below on technical solutions provided by the present disclosure in combination with FIG. 1 to FIG. 6*c*.

Figure 1:
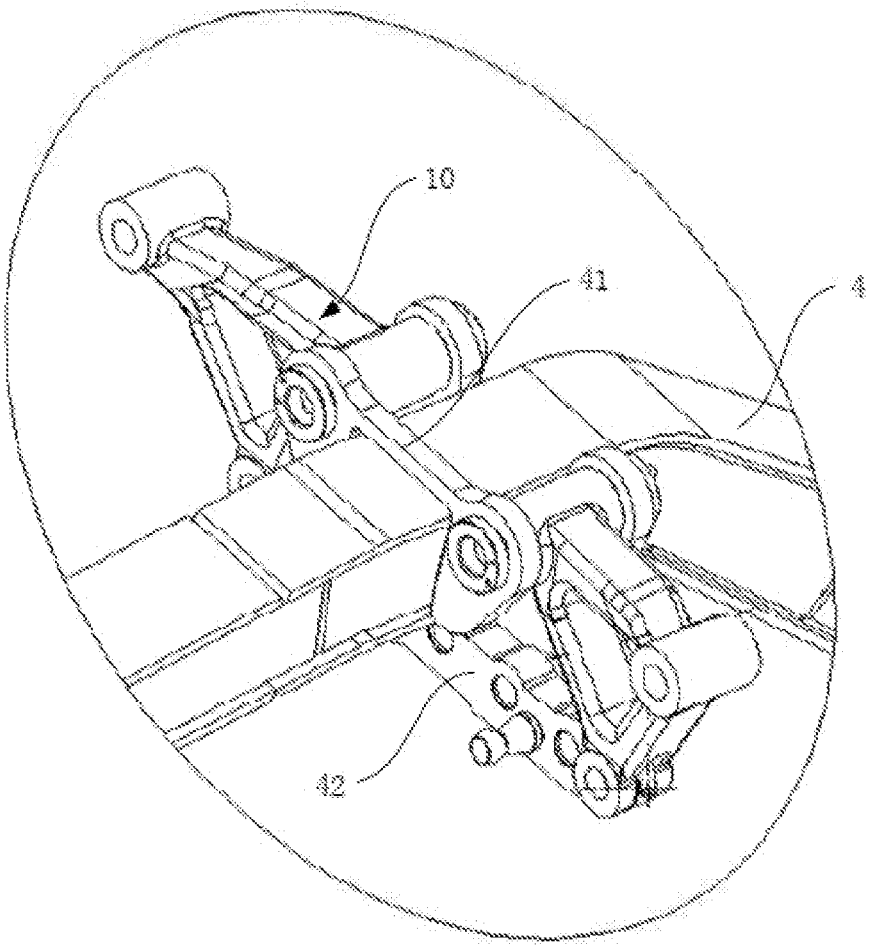
FIG. 1 is a first stereoscopic diagram showing that a swing frame of a land leveler provided by some embodiments of the present disclosure is in a using state.

Please refer to FIG. 1. Embodiments of the present disclosure provide a land leveler which comprises a vehicle frame 4 and a swing frame 10. The swing frame 10 comprises a supporting beam assembly 1 and connecting parts. The supporting beam assembly 1 comprises multiple beam members, and the multiple beam members are connected sequentially at end parts, such that the multiple beam members form a closed shape. The connecting part is arranged at the connecting end part between two adjacent beam members. At least two connecting parts are provided. At least one connecting part is rotatably connected with the vehicle frame 4, and at least another connecting part is rotatably connected with a driving part.

With the supporting beam assembly 1 including three beams as an example, sequential connection at the end parts means that the end of each beam is connected with other beams, and the whole supporting beam assembly 1 is approximately a triangle.

In some embodiments, the beams of the supporting beam assembly 1 are constructed to be of the same strength. A driving part comprises an oil cylinder.

The structures of the connecting parts are identical or different. The connecting parts are used for realizing connection between the swing frame 10 and the vehicle frame 4 and between the swing frame 10 and the oil cylinder.

The top end of the supporting beam assembly 1 means a protruding position of the supporting beam assembly when the supporting beam assembly is taken as a whole. With a triangle structure as an example, the end part of the supporting beam assembly 1 refers to three vertices of a triangle structure.

Figure 2:
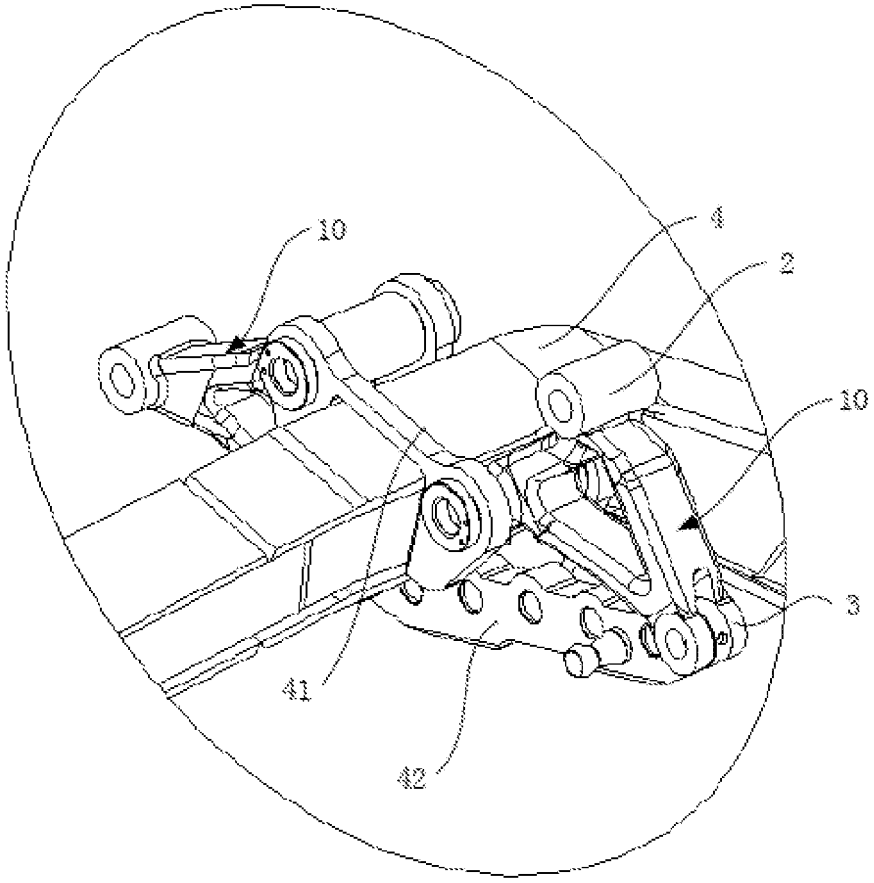
FIG. 2 is a second stereoscopic diagram showing that a swing frame of a land leveler provided by some embodiments of the present disclosure is in a using state.

Please refer to FIG. 2. In some embodiments, the connecting parts include a first connecting part 2 and a second connecting part 3, two first connecting parts are respectively arranged at two end parts of the supporting beam assembly 1. The second connecting part 3 is arranged at another top end of the supporting beam assembly 1.

The first connecting part 2 and the second connecting part 3 for example have different structures. The first connecting part 2 is constructed to be cylindrical. The second connecting part 3 comprises two hinged ears which are arranged at intervals.

Figure 5A:
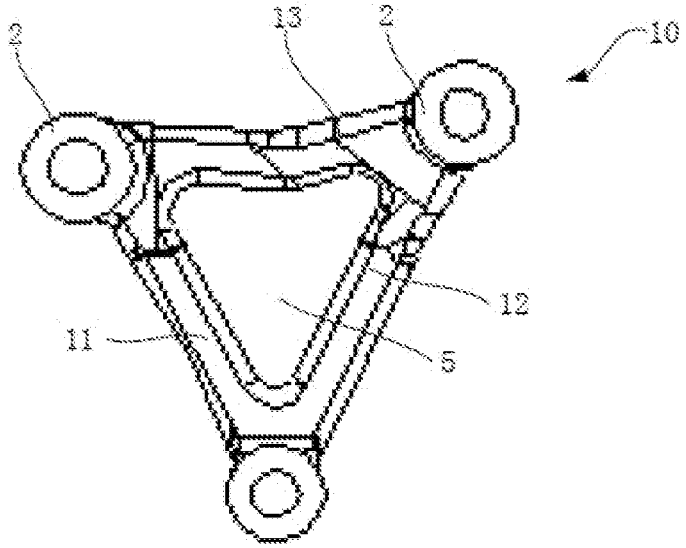
FIG. 5*a* is a first schematic diagram of some optional positions of a first connecting part of a swing frame of a land leveler provided by some embodiments of the present disclosure.
Figure 5B:
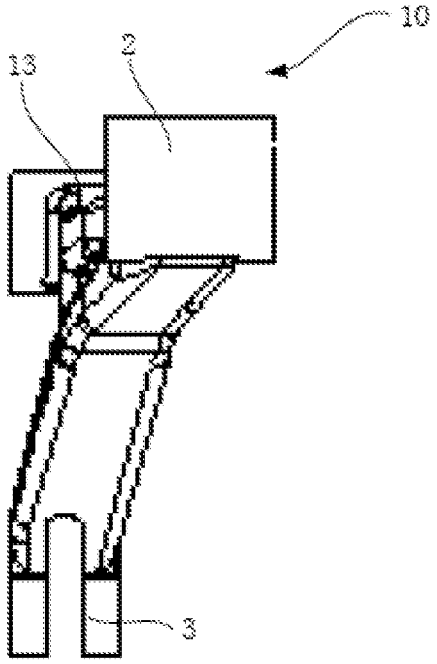
FIG. 5*b* is a second schematic diagram of some optional positions of a first connecting part of a swing frame of a land leveler provided by some embodiments of the present disclosure.
Figure 5C:
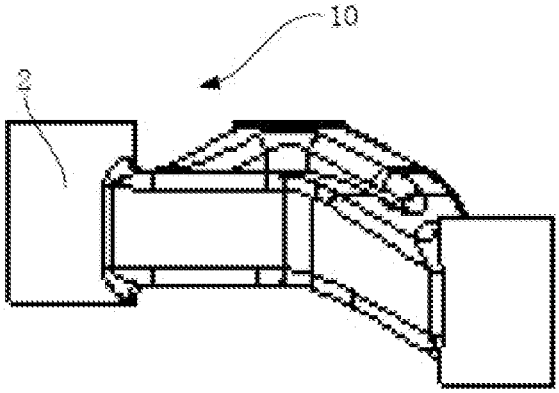
FIG. 5*c* is a third schematic diagram of some optional positions of a first connecting part of a swing frame of a land leveler provided by some embodiments of the present disclosure.
Figure 6A:
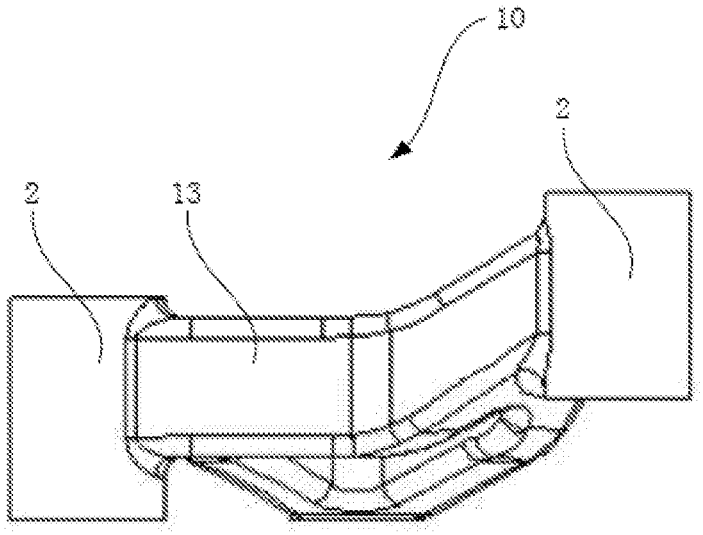
FIG. 6*a* is a first schematic diagram of some other optional positions of a first connecting part of a swing frame of a land leveler provided by some embodiments of the present disclosure.
Figure 6B:
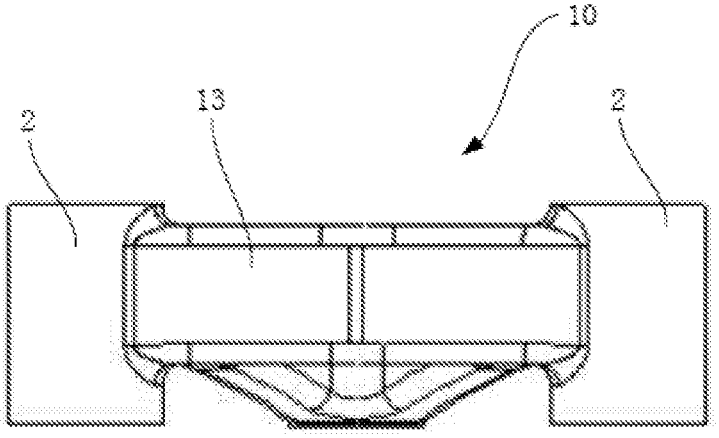
FIG. 6*b* is a second schematic diagram of some other optional positions of a first connecting part of a swing frame of a land leveler provided by some embodiments of the present disclosure.
Figure 6C:
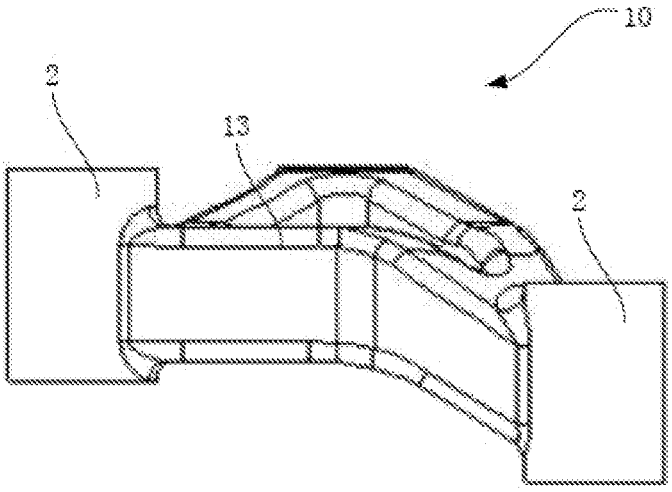
FIG. 6*c* is a third schematic diagram of some other optional positions of a first connecting part of a swing frame of a land leveler provided by some embodiments of the present disclosure.

An optional arrangement mode of the first connecting part 2 is as shown in FIG. 5*a* to FIG. 6*c*. FIG. 5*a* to FIG. 5*c* show some arrangement modes, while FIG. 6*a* to FIG. 6*c* show some other arrangement modes.

In the above technical solution, the structures of the connecting parts at two end parts of the swing frame 10 are identical, and are both cylindrical. The connecting part of the third end part is a hinged ear. The connecting relationship among the three connecting parts is specifically as follows: one of the cylindrical structure is rotatably connected with a connecting plate 41 on the vehicle frame 4, specifically with the connecting plate 41 on the front rack. Another cylindrical structure is rotatably connected with an oil cylinder. The hinged ear is rotatably connected with a beam 42 of the front rack. The front rack in its entirety, the swing frame 10 and the oil cylinder form a four-bar mechanism. Through changing a rotatably connecting position between the hinged ear and the beam 42 of the front rack, the pose of the swing frame 10 is adjusted, and further an operating condition of the land leveler is adjusted. As to the swing frame 10 provided in the above technical solution, when the swing frame 10 swings to its limit position, the structure of the swing frame 10 is subjected to a bending moment and a torque. Even if the operating performance of the land leveler is improved, the tonnage increases, and the width of the scraper knife and the load correspondingly increase, the bending resistance and torsional property of the structure of the swing frame 10 still satisfy operating requirements, so as to increase stability of the whole vehicle.

Figure 4:
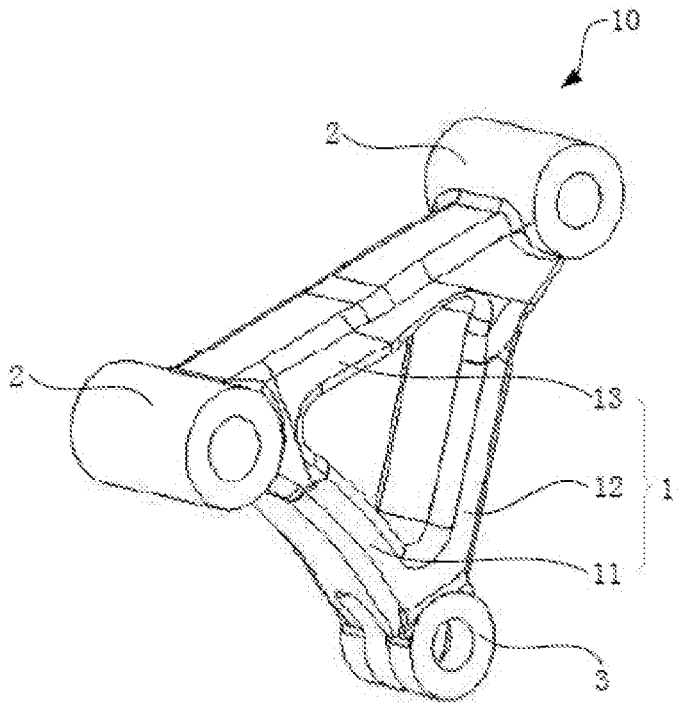
FIG. 4 is a schematic diagram of a three-dimensional structure of a swing frame of a land leveler provided by some embodiments of the present disclosure.

Refer to FIG. 1 and FIG. 4. In some embodiments, the supporting beam assembly 1 comprises a first beam member 11, a second beam member 12 and a third beam member 13. A first end of a second beam member 12 is connected with a first end of the first beam member 11. A first end of a third beam member 13 is connected with a second end of the second beam member 12. A second end of third beam member 13 is connected with a second end of the first beam member 11.

The structures of the first beam member 11, the second beam member 12 and the third beam member 13 are approximately the same. Specifically, the structures of the first beam member 11 and the second beam member 12 are almost identical, while a hinged ear is arranged at the position at which the first beam member 11 is connected with the second beam member 12. A cylindrical structure is arranged at another two end parts of a triangle structure. Since the structure of the hinged ear is different from a cylindrical structure, the structure of the third beam member 13 is different from the structure of the first beam member 11 at the end. Specifically, no groove is arranged at the end part of the third beam member 13, while a groove is arranged at the end parts of the first beam member 11 and the second beam member 12, and the structure of the groove is corresponding to that of the hinged ear.

In some embodiments, the first beam member 11 is straight or bent. And/or, the second beam member 12 is straight or bent. And/or, the third beam member 13 is straight or bent. For example, the three beam members are all straight beams, or are all bent towards the inside of the supporting beam assembly 1. Or one or two of the beam members are straight beams, while the remaining beams are bent.

The shape of each beam of the supporting beam assembly 1 will be introduced below. The cross section of the first beam member 11 is rectangular, circular, I-shaped or U-shaped. And/or, the cross section of the second beam member 12 is rectangular, circular, I-shaped or U-shaped. And/or, the cross section of the third beam member 13 is rectangular, circular, I-shaped or U-shaped.

To continue with what is described above, each beam of the supporting beam assembly 1 is constructed to be of the same strength. Specifically, the first beam member 11, the second beam member 12 and the third beam member 13 are constructed to be of the same strength. The structure enables that the first beam member 11, the second beam member 12 and the third beam member 13 all bear well no matter the swing frame 10 is located at what kind of operating position.

Please refer to FIG. 4. In some embodiments, the first beam member 11 and the second beam member 12 have the same length.

Please refer to FIG. 4. In some embodiments, the first beam member 11 and the third beam member 13 have the same length.

Please refer to FIG. 4 and FIG. 5*a*, in some embodiments, the first beam member 11, the second beam member 12 and the third beam member 13 enclose a triangle with a gap 5 in the center.

The contour shape of the gap 5 is also approximately a triangle. The gap 5 of the triangle is beneficial for the driver to observe visual field of front wheels of the land leveler, and observe conditions of the front wheels, meanwhile, the driver does not need observe sideways, thereby reducing hidden dangers to personal safety of the driver during driving.

The supporting beam assembly 1 is approximately in a shape of an inverted triangle, and the gap 5 is also in a shape of an inverted triangle. The supporting beam assembly 1 bears the bending resistance and torsion resistance effects of the swing frame 10.

In some embodiments, the first beam member 11, the second beam member 12 and the third beam member 13 are welded. The welded supporting beam assembly 1 is convenient for processing and manufacturing, and under the premise that the bearing capability satisfies requirements, the size is small and the weight is light.

In some embodiments, the supporting beam assembly 1 is cast. The supporting beam assembly is cast in a whole, therefore, its structural strength is better, and the bearing capability is also better.

As to the above technical solution, through a topology optimal design, and by adopting a casting mode, a novel arrangement structure of the swing frame 10 of the land leveler is formed. The structure is not only light in weight, but also has strong bending stiffness and strength, thereby effectively solving the contradiction between structure weight and structure stiffness and strength, being beneficial for lightweight design of the structure of the swing frame 10 of the land leveler, being beneficial for reliability of the structure of the swing frame 10 of the land leveler, and improving operating safety and stability of the whole vehicle.

Figure 3:
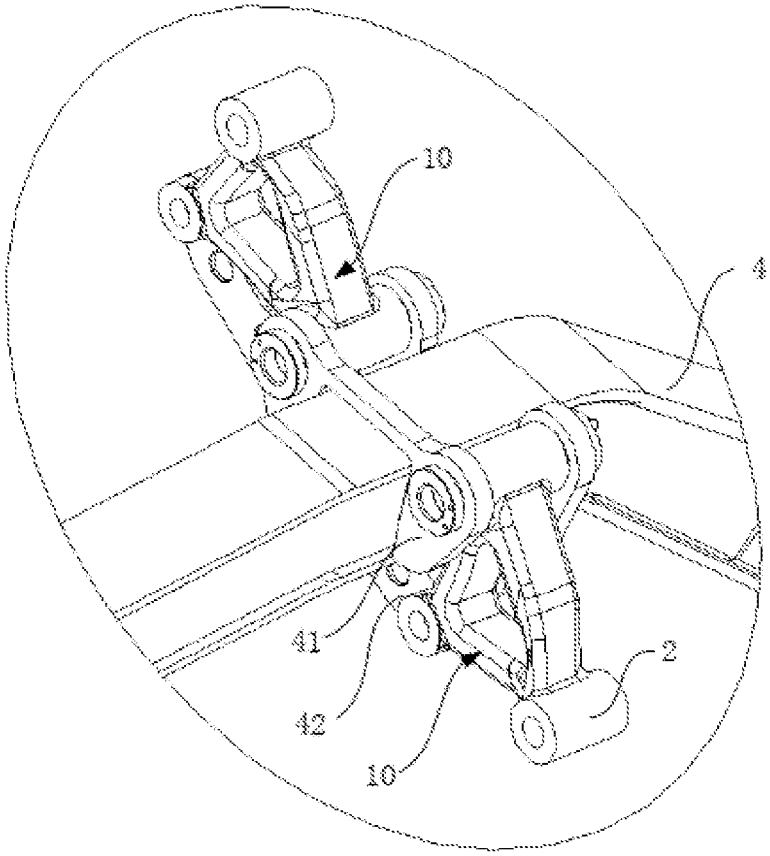
FIG. 3 is a third stereoscopic diagram showing that a swing frame of a land leveler provided by some embodiments of the present disclosure is in a using state.

Please refer to FIG. 3. The swing frame 10 is arranged to be symmetrical to the vehicle frame 4, and generally two swing frames 10 are arranged. With a gazing direction of the driver as a reference, one swing frame is arranged at a left side of the sight line of the driver, while one swing frame is arranged at a right side of the sight line of the driver.

In some embodiments, two of the end parts of the swing frame 10 are rotatably connected with the vehicle frame 4. Please refer to FIG. 3, one of the cylindrical structures is rotatably connected with the connecting plate 41 on the front rack, another cylindrical structure is rotatably connected with an oil cylinder, and the hinged ear is rotatably connected with the beam 42 of the front rack. The front rack in its entirety, the swing frame 10 and the oil cylinder form a four-bar mechanism. Specifically, the connecting plate 41 on the front rack, the beam 42 of the front rack, the swing frame 10 and the oil cylinder form a four-bar mechanism. Through changing a rotatably connecting position between the hinged ear and the beam 42 of the front rack, the pose of the swing frame 10 is adjusted, and further an operating condition of the land leveler is adjusted.

In description of the present disclosure, it needs to the understood that, orientation or position relations denoted by the terms "center", "longitudinal", "lateral", "front", "rear", "left", "right", "vertical", "horizontal", "top", "bottom", "inner", "outer" and the like are orientation or position relations based on illustration in the figures, and are only intended to facilitate describing the present disclosure and simplifying description, instead of indicating or implying that the denoted devices or elements necessarily have specific orientations or are constructed and operated in specific orientations, and thus they should not be understood as a limitation to the protection scope of the present disclosure.

Finally, it should be noted that, the above embodiments are merely used for describing technical solutions of the present disclosure, rather than limiting the present disclosure; although the present disclosure is described in detail with reference to preferred embodiments, those skilled in the art should understand that, specific embodiments of the present disclosure are still modified or part of the technical features are equivalently substituted; and such modifications or equivalent substitutions without departing from the spirit of technical solutions of the present disclosure shall all fall within the scope of technical solutions claimed to be protected in the present disclosure.

The invention claimed is:

1. A land leveller, comprising:

a vehicle frame; and a swing frame which comprises:

a supporting beam assembly and three connecting parts, wherein the supporting beam assembly comprises multiple beam members, and wherein the multiple beam members are connected sequentially at end parts, such that the multiple beam members form a closed shape;

a connecting part is arranged at a connecting end part between two adjacent beam members; and at least one connecting part is rotatably connected with the vehicle frame, and at least another connecting part is rotatably connected with a driving part, wherein the supporting beam assembly is constructed to be an isosceles triangle, and wherein the supporting beam assembly is welded or cast.

2. The land leveller according to claim 1, wherein the supporting beam assembly comprises:

a first beam member;

a second beam member, with a first end being connected with a first end of the first beam member; and a third beam member, with a first end being connected with a second end of the second beam member, and a second end being connected with a second end of the first beam member.

3. The land leveller according to claim 2, wherein at least one of the first beam member, the second beam member and the third beam member is straight or bent.

4. The land leveller according to claim 2, wherein a cross section of at least one of the first beam member, the second beam member and the third beam member is rectangular, circular, I-shaped or U-shaped.

5. The land leveller according to claim 2, wherein the first beam member and the second beam member have the same length.

6. The land leveller according to claim 2, wherein the first beam member and the third beam member have the same length.

7. The land leveller according to claim 2, wherein the first beam member, the second beam member and the third beam member enclose a triangle with a gap in the center.

8. The land leveller according to claim 1, wherein the supporting beam assembly is constructed to be an equilateral triangle.

9. The land leveller according to claim 1, wherein the three connecting parts comprise:

two first connecting parts and one second connecting part;

two first connecting parts are respectively arranged at two top ends of the supporting beam assembly; and the second connecting part is arranged at another top end of the supporting beam assembly.

10. The land leveller according to claim 9, wherein the two first connecting parts is constructed to be cylindrical, and/or the second connecting part comprises two hinged ears which are arranged at an interval.

11. The land leveller according to claim 9, wherein the driving part comprises an oil cylinder; one of the first connecting parts is rotatably connected with a connecting plate of a front rack of the vehicle frame, another first connecting part is rotatably connected with the oil cylinder; the second connecting part is rotatably connected with a beam of the front rack of the vehicle frame; and the connecting plate of the front rack, the beam of the front rack, the swing frame and the oil cylinder form a four-bar mechanism.

* * * * *